US006715331B1

(12) United States Patent
Zelin et al.

(10) Patent No.: US 6,715,331 B1
(45) Date of Patent: Apr. 6, 2004

(54) DRAWING OF STEEL WIRE

(75) Inventors: Michael Gregory Zelin, Canal Fulton, OH (US); James Terry Lewis, Cuyahoga Falls, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 10/322,997

(22) Filed: Dec. 18, 2002

(51) Int. Cl.[7] ..... B21C 1/00; B21C 9/00
(52) U.S. Cl. ..... 72/278; 72/286
(58) Field of Search ..... 72/278, 281, 282, 72/286

(56) References Cited

U.S. PATENT DOCUMENTS

| | | | | | |
|---|---|---|---|---|---|
| 3,196,052 | A | * | 7/1965 | Hann | 72/274 |
| 3,486,361 | A | * | 12/1969 | Vaneman | 72/278 |
| 4,046,600 | A | | 9/1977 | Yamakoshi et al. | 148/12.4 |
| 4,795,609 | A | | 1/1989 | Saka et al. | 420/109 |
| 4,842,818 | A | | 6/1989 | Kate et al. | 420/100 |
| 4,854,032 | A | | 8/1989 | Dambre | 29/527 |
| 5,211,772 | A | | 5/1993 | Ashida et al. | 148/336 |
| 5,240,520 | A | | 8/1993 | Tarni et al. | 148/532 |
| 5,248,353 | A | | 9/1993 | Nishida et al. | 148/598 |
| 5,261,974 | A | | 11/1993 | Hyodo et al. | 148/320 |
| 5,535,612 | A | | 7/1996 | Vijayakar | 72/43 |
| 5,603,208 | A | | 2/1997 | Fujita et al. | 57/200 |
| 5,609,013 | A | | 3/1997 | Kaaneda et al. | 57/200 |
| 5,749,981 | A | | 5/1998 | Tonteling et al. | 148/595 |
| 5,822,973 | A | | 10/1998 | Kaneko et al. | 57/902 |
| 5,873,961 | A | | 2/1999 | Bhagwat et al. | 148/595 |
| 5,888,321 | A | | 3/1999 | Kazama et al. | 152/451 |
| 5,956,935 | A | * | 9/1999 | Katayama et al. | 57/212 |
| 6,048,416 | A | | 4/2000 | Hauser et al. | 148/500 |
| 6,082,163 | A | * | 7/2000 | Hara | 72/280 |
| 6,099,797 | A | | 8/2000 | Bhagwat et al. | 420/91 |
| 6,264,759 | B1 | * | 7/2001 | Bae et al. | 148/320 |
| 6,322,641 | B1 | | 11/2001 | Makii et al. | 148/330 |
| 6,402,858 | B1 | | 6/2002 | Ishizaka | 148/333 |
| 6,418,994 | B1 | | 7/2002 | Arnaud et al. | 152/556 |

* cited by examiner

*Primary Examiner*—Daniel C. Crane
(74) *Attorney, Agent, or Firm*—Nancy T. Krawczyk

(57) ABSTRACT

Steel wire is drawn from an initial diameter to a desired final or intermediate diameter by the use of a non-linear tapered draft. During the non-linear tapered draft, the wire is drawn through a series of successive dies, reducing the wire diameter to a desired diameter, wherein the drawing strain at each successive die is gradually reduced. The drawing strain is based upon the actual strength of the steel at each die. The wire may also be subjected to a skin pass, reducing the wire by a diameter by less than 4%, following reduction of the wire to either the final or the intermediate diameter.

13 Claims, 4 Drawing Sheets

DRAWING OF STEEL WIRE

FIELD OF THE INVENTION

The present invention is directed to methods of drawing a steel wire. Specifically, the wire is subjected to a non-linear method of drawing a steel wire, resulting in an increased strength of the wire.

BACKGROUND OF THE INVENTION

It is frequently desirable to reinforce rubber articles (such as, tires, conveyor belts, power transmission belts, timing belts and hoses) by incorporating therein steel reinforcing elements. Pneumatic vehicle tires are often reinforced with cords prepared from brass-coated steel filaments. Such tire cords are frequently composed of high carbon steel or high carbon steel coated with a thin layer of brass. Such a tire cord can be a monofilament, but normally is prepared from several filaments that are stranded together. In most instances, depending upon the type of tire being reinforced, the strands of filaments are further cabled to form the tire cord. It is important for the steel alloy utilized in filaments for reinforcing elements to exhibit high strength and ductility as well as high fatigue resistance.

Transformation of the steel alloy into a filament suitable for reinforcing rubber articles involves multiple processing stages, including rough drawing, patenting, brass plating and fine drawing. The selected process to achieve a steel wire with defined characteristics can include many variations on those processing stages, including repeating the different stages.

Typically, rough drawing, i.e. dry drawing of a rod to an intermediate wire diameter, is accomplished by using a taper draft. In a taper draft, larger diameter reductions are made at the beginning die positions while the wire is ductile, i.e. a relatively high drawing strain is used, and at the final die position, smaller reductions are made, i.e. a relatively lower drawing strain is employed, when the wire has a higher strength due to strain hardening. Conventional linear taper drafts are designed to achieve equal work done at the first and the last die position, and the dependence of the strain on the die position represents a straight line. In this approach, only original wire strength and the final strength are taken into account, while the wire strength at the intermediate die positions is not considered. Thus the amount of drawing strain employed through the die positions is reduced by a constant amount as the wire diameter is reduced. FIG. 3 illustrates the drawing strain and die position relationship for a linear taper draft. Such linear tapered drawing is only used during rough drawing.

Another known method of drafting is an even area reduction draft. During even area reduction, the drawing strain applied at each successive die in the die path is the same as the diameter of the wire is slowly reduced. Even area reduction is employed during both rough and fine drawing.

SUMMARY OF THE INVENTION

The invention provides solutions for designing optimized die drawing drafts to achieve increased efficiency of the drawing process and high strength wires with improved torsion characteristics. The invention takes into account the actual wire strength at the intermediate die positions while drawing a wire to a final desired diameter.

Disclosed is a process for forming a drawing of a wire to smaller diameter, either an intermediate bright wire size or a final desired diameter.

Disclosed is a process for drawing a wire to a desired diameter comprising the steps of selecting a wire having an initial diameter and drawing the wire through a series of wire dies to reduce the wire diameter to a desired diameter wherein the drawing strain at each successive die is gradually reduced. This method of drawing is referred to as a non-linear tapered draft.

In one aspect of the invention, the drawn wire has a final desired diameter of about 0.1 to about 0.4 mm. Such a diameter range is exemplary for a final diameter after both a rough draw, patenting, and a final drawing. Alternatively, if the drawing of the wire by means of the non-linear tapered draft is the rough drawing, than the final desired diameter is about 2.5 to about 1.0 mm. Both of these diameters are preferably for an initial wire diameter is about 4.0 to about 5.5 mm and such wires are most useful in tire manufacturing, automotive part manufacturing, and conveyors belts.

Also disclosed is that the wire may be drawn again after the non-linear tapered draft; thus the non-linear tapered draft occurs during the rough draw. The additional drawing following the rough draw may be a skin pass wherein the diameter is reduced by less than 4% or it may be a desired fine draw.

If the additional draw is the fine drawing of the wire done to the final wire diameter, the draft technique used may be selected from among the following drawing methods: gradually reducing the drawing strain at each successive die (i.e., non-linear tapered draft); reducing the drawing strain at each successive die by a constant amount (linear tapered draft); applying a constant drawing strain at each successive die (even area reduction); or a combination of any of the above.

In another aspect of the disclosed invention, Applicants teach employing a skin pass following the rough drawing of the wire from an initial diameter to a bright wire diameter. The type of draft employed during the rough drawing is irrelevant and may be the non-linear tapered draft, the linear tapered draft, even area reduction, or even a combination of these types.

BRIEF DESCRIPTION OF THE DRAWINGS

The invention will be described by way of example and with reference to the accompanying drawings in which.

DETAILED DESCRIPTION OF THE INVENTION

Figure 1:
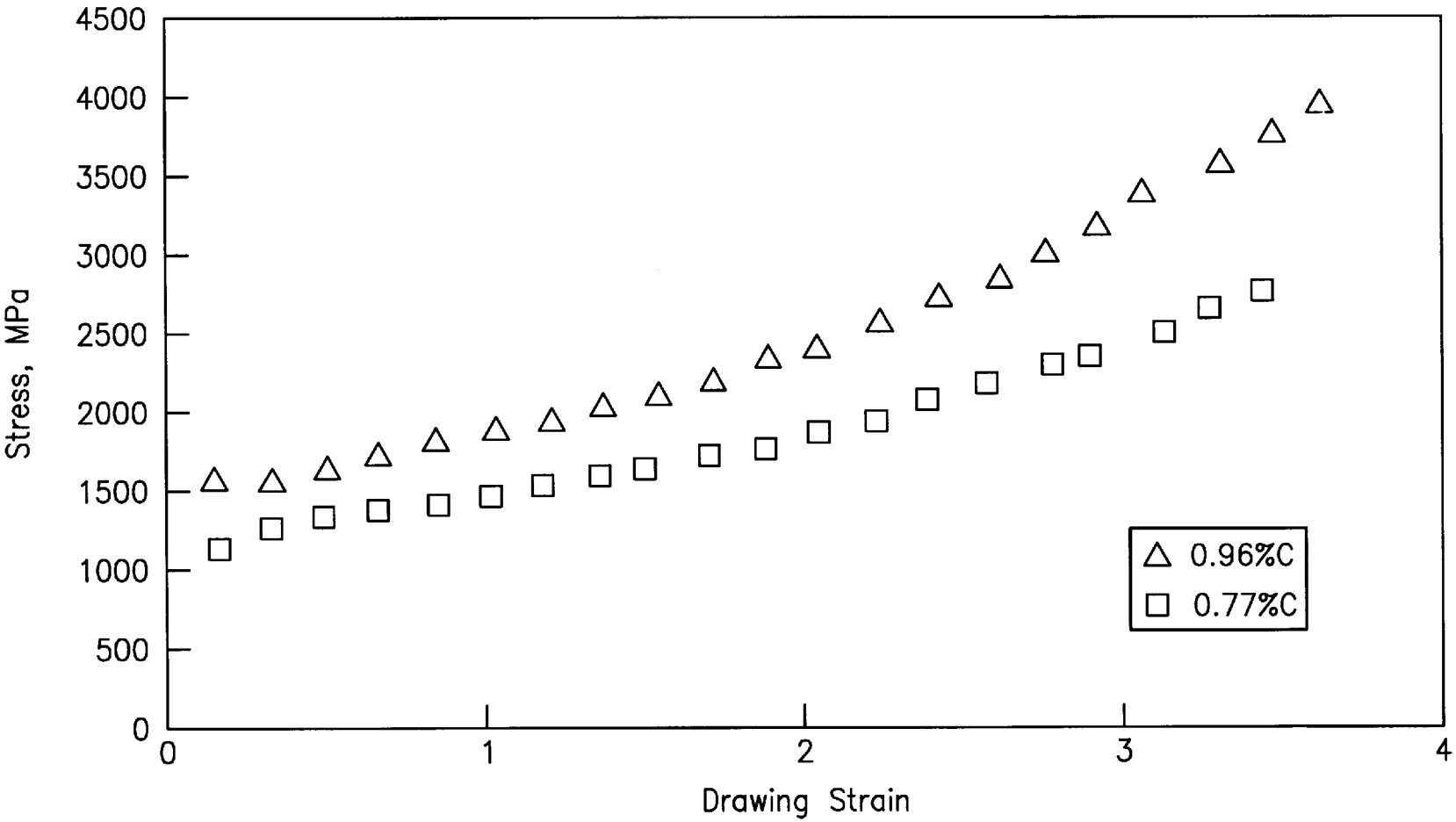
FIG. 1 is a graph showing the dependence of the tensile strength as a function of drawing strain.

As discussed, drawing of the wire reduces the wire diameter while increasing the strength characteristics of the wire. FIG. 1 is a graph showing the relationship between the tensile strength and the drawing strain of wires. The upper curve represents steel with a carbon content of 0.96%, and the lower curve represents steel with a carbon content of 0.77%. For each steel composition, the tensile strength increases as the drawing strain is increased.

A typical wire forming process includes two distinct drawing stages and typically starts with a rough drawing and terminates with a fine drawing. In rough drawing, usually accomplished using a dry lubricant, the original rod diameter is reduced to an intermediate wire diameter, also known as the bright wire diameter. After that, the wire is typically heat treated (i.e. patented) to restore drawability and then subjected to fine drawing. In fine drawing, wire is drawn by using a wet lubricant to its final diameter. In both rough and fine drawing, wire is drawn through a multitude of wire drawing dies. It is desirable to use die drafts reducing dynamic strain aging and surface residual stresses negatively impacting wire properties and excessive die wear.

The present invention provides solutions for achieving these desired effects during the different drawings by using drawings differing from those previously known and employed. Disclosed are combinations of different drafts used at different times, skin passes, non-linear tapered drafts, and mixed taper-even area reduction drafts.

Non-linear tapered draft. In contrast to the conventional linear taper draft, as previously discussed, which takes into account the wire strength only at the first and the last die positions, the drawing strain in a non-linear tapered draft is calculated based upon the actual steel wire strength during each phase of the wire drawing. As the wire passes through the non-linear tapered draft, the reduction in diameter is greater when the steel is soft and has a relatively high ductility, and the drawing strain to which the wire is subjected is greater, and the reduction in diameter at the final stages of the drawing process is relatively smaller than at the beginning of the drawing process, that is—the drawing strain to which the wire is subject is relatively less.

Figure 2:
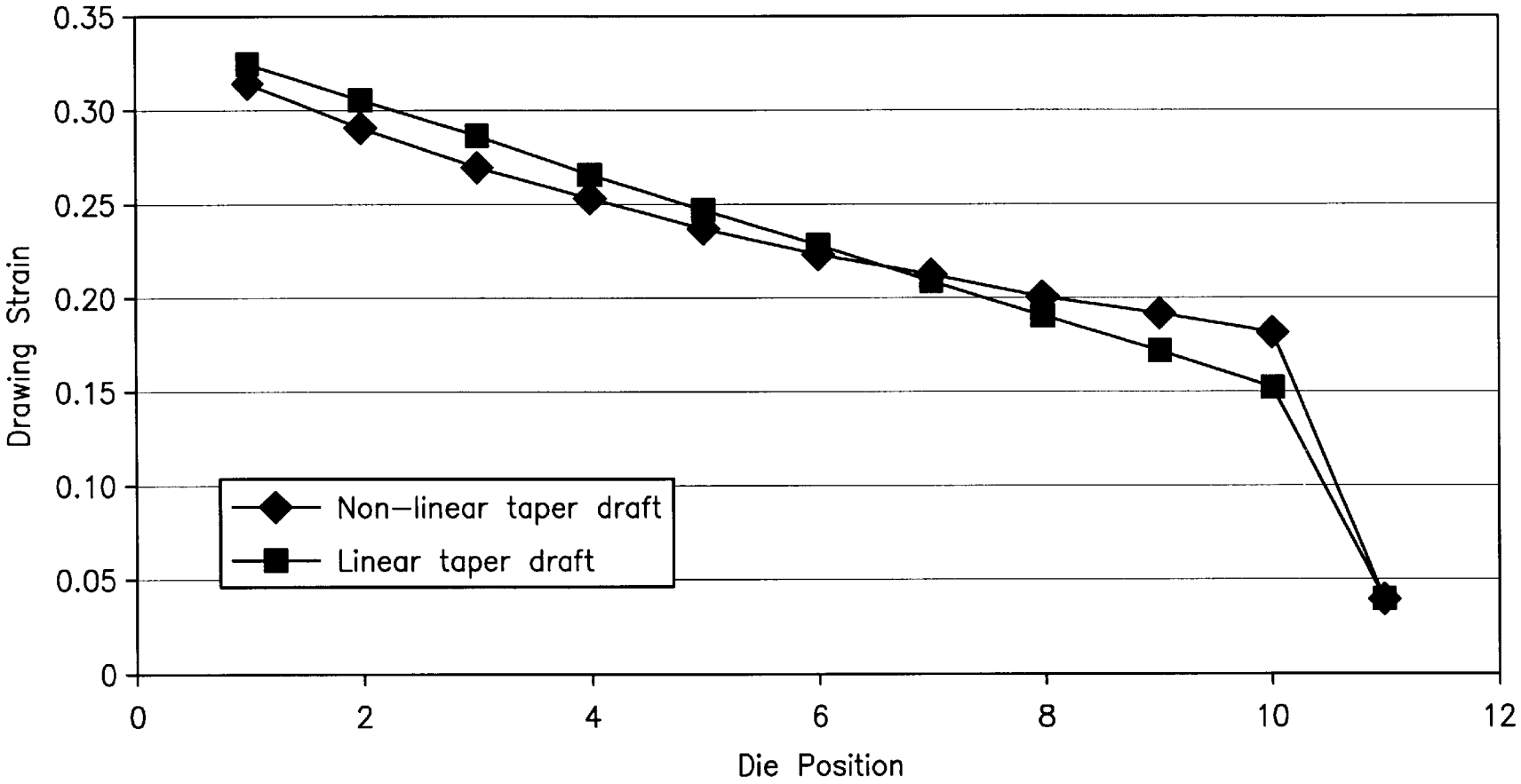
FIG. 2 is a comparison of a linear tapered draft and a non-liner tapered draft.

While the initial and final steps may be similar to linear taper draft, the distinction is the change in drawing strain during the intermediate successive dies. As seen in FIG. 2, by basing the drawing strain on the actual wire strength, the process results in a non-linear drawing process, as defined by the drawing strain versus the die positions. The drawing strain to which the wire is subjected is gradually reduced at successive dies; that is, the drawing strain at each successive die is reduced from the previous die by a non-constant amount.

Since the non-linear tapered draft is based upon the actual wire strength, the actual wire strength must be first determined prior to setting up the dies for the draft. The actual wire strength can be determined by experimental drawing and measuring the actual strength at drawing or by the following equation:

$$Y=Y_o\exp(\alpha\epsilon)$$

wherein Y is the tensile strength in MPa ($N/mm^2$), $Y_o$ is the strength of the wire after patenting, $\alpha$ is a coefficient dependant on wire chemistry and drawing conditions, and $\epsilon$ is a total true drawing strain. The coefficient $\alpha$ is typically in the range of 0.2 to 0.5 for high carbon steel.

For wires to be used in tire manufacturing, an initial wire diameter ranges from 4.0 to 6.0 mm and is reduced to an intermediate diameter of 2.5 to 1.0 mm.

The non-linear tapered draft reduces wire overheating thereby eliminating strain aging during wire drawing and reducing die wear. This process also improves wire drawability and reduces the probability of micro-crack formations in the bright wire.

The non-linear tapered draft may also be employed during the fine drawing of the wire, following patenting of the wire, instead of the conventional even area reduction drawing. Prior to the fine draw, the wire may be treated for corrosion resistance and to improve the drawability and adhesion characteristics of the wire. For example, the wire may be coated with a thin layer of brass or brass alloys to improve adhesion of the steel wire to elastomers. Preferably brass is the coating of choice and the coating weight should be sufficient to remain on the filament after the drawing operation, also the brass should be predominately alpha brass in order to facilitate the drawability.

Figure 3:
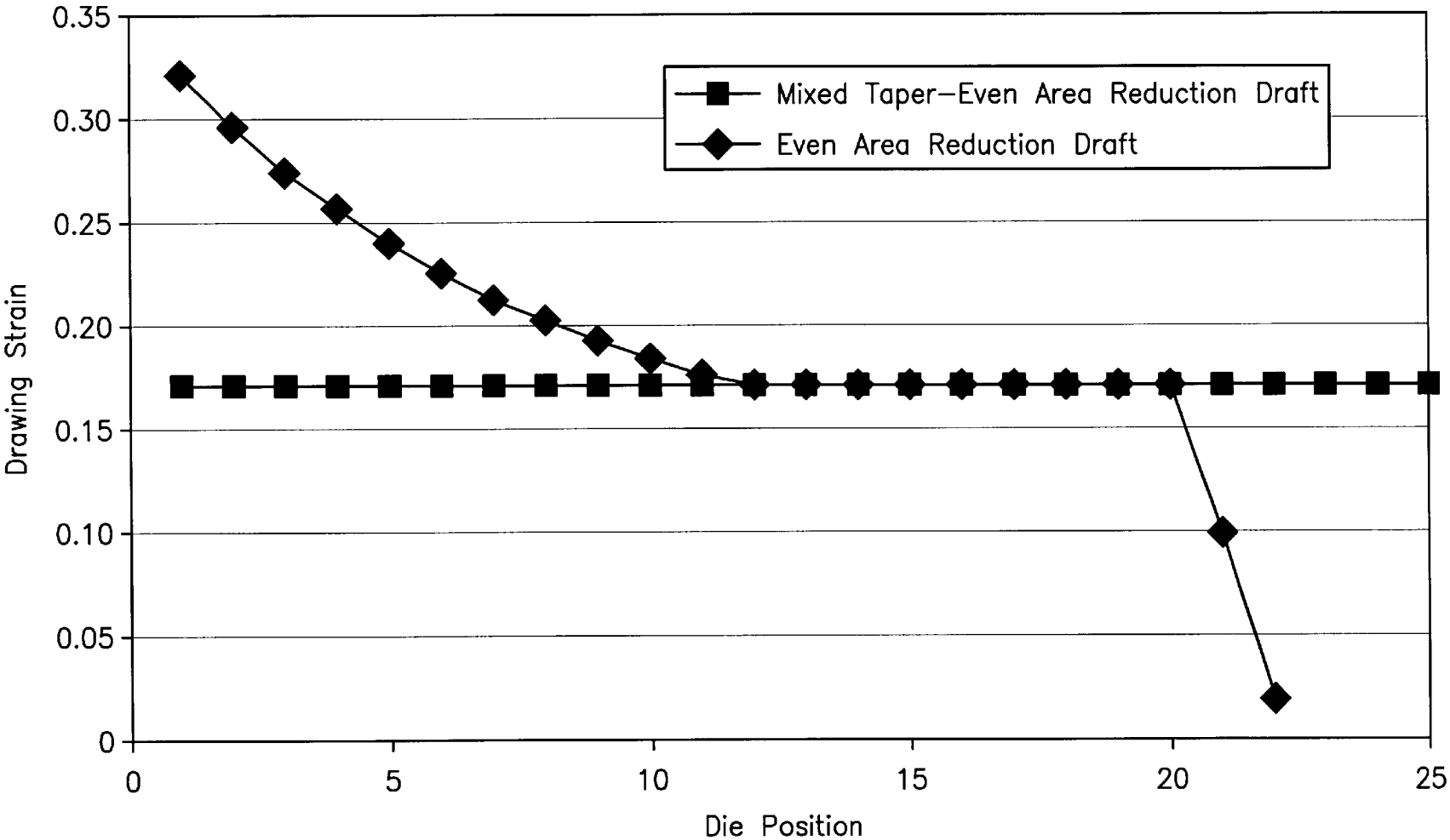
FIG. 3 is a comparison of non-linear tapered drawing and standard even area reduction during fine drawing.

The non-linear tapered draft can also be used in combination with other conventional drafts to achieve either rough drawing or fine drawing. FIG. 3 graphs the use of the non-linear tapered draft in combination with an even area tapered draft during fine drawing of a wire, followed by a skin pass, to reduce the intermediate diameter wire from 1.6 mm to a final 0.2 mm diameter. This draft is compared to a constant even area reduction draft. In fine drawing, the even area reduction draft is the conventional draft process employed. The final wire diameter, typical for use in tire manufacturing, ranges from about 0.1 to about 0.4 mm.

For both rough drawing and fine drawing of a high strength, the nonlinear tapered drawing is accomplished using the dies having an 8° approach angle, as understood by those skilled in the art. The drawing can also be achieved with different approach angles, including known 10° or 12° dies. The disclosed drawing methods are applicable in manufacturing wires having any strength, but are most applicable for manufacturing high tensile strength wires with strengths preferably greater than 4000 MPa.

The use of the non-linear tapered draft improves wire processability, eliminates dynamic aging, avoids the need for an intermediate patenting process as used in conventional wire formation, thereby increasing processing efficiency and reducing wire manufacturing time. Additionally, since the drawing is optimized, the number of dies used in the fine drawing stage can be reduced yielding cost savings and improved process efficiency.

Linear Tapered Draft. As previously discussed, during a linear tapered draft, the amount of the drawing strain applied to the wire during drawing is reduced by a constant amount between successive dies. This method has conventionally only been employed during rough drawing of the wire from an initial wire diameter to an intermediate bright wire diameter. Applicants have determined that linear tapered draft can also successively be used during fine drawing of the wire. The use of linear tapered draft during fine drawing reduces the number of dies employed, reducing manufacturing costs while varying the amount of drawing strain and the resulting strength characteristics of the wire. The use of a non-even area drafting technique used during fine drawing, even if used in combination with an even area draft, enables the engineer to achieve a more specific strength in the finished wire and control the overall finished characteristics of the wire.

Skin Pass. A skin pass is a small reduction of the wire diameter, not more than 4% of the initial diameter, occurring either at the final die in a set of dies during a draw or during a separate step following drawing. Conventionally, a skin pass is employed only following fine drawing of the wire. The inventors have determined that skin passes may be employed whenever control of torsion properties is essential, and skin passes may be employed also during rough drawing of the wire regardless of the type of drawing employed.

Figure 4:
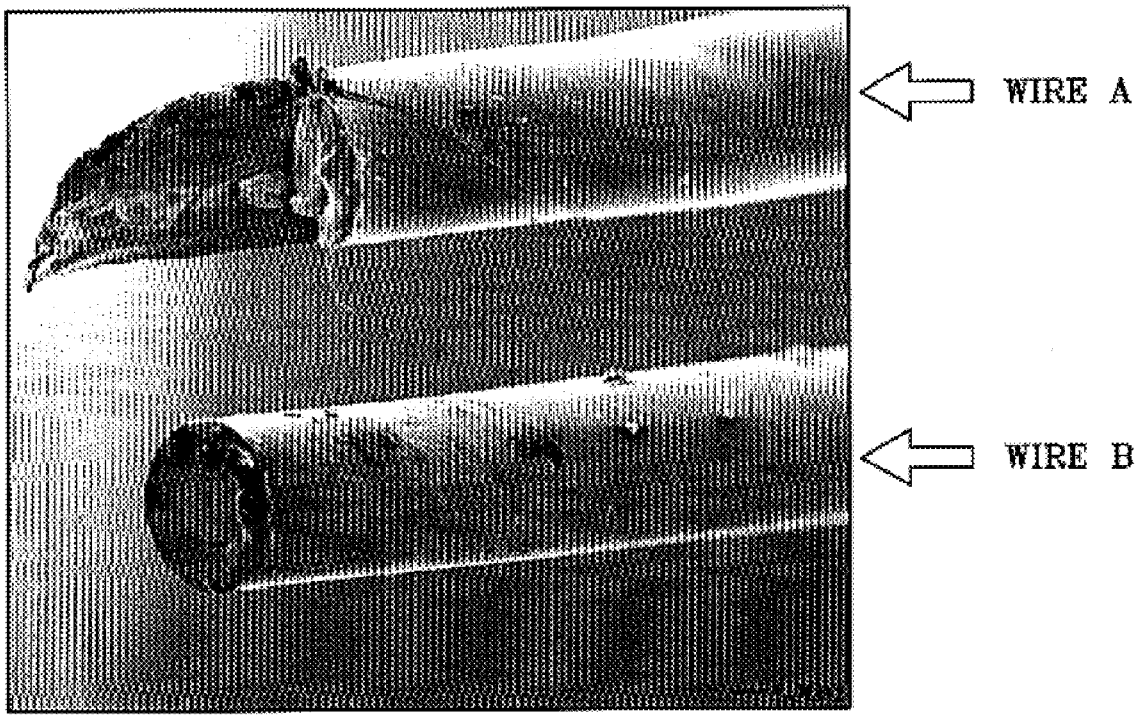
FIG. 4 is a comparison of the breaking characteristics of a wire subjected to a skin pass and a wire with no skin pass.

FIG. 4 illustrates two wires subjected to a torsion test. Wire A was drawn using a conventional linear taper draft without a skin pass with the total drawing strain of 3.64. Wire B, of the same composition, was drawn using a linear taper draft followed by a 4% reduction skin pass, resulting in the total drawing strain of 3.68. Both wires were then subjected to a torsion test. The wire drawn without a skin pass shows delamination, i.e. axial cracking splitting the wire along its axis. The wire drawn with a skin pass did not delaminate even when the total drawing strain was higher as compared with the wire drawn without skin pass. The use of the skin pass reduces wire delamination thereby improving torsion characteristics of the wire.

The resulting wires formed using any of the disclosed combinations of drawing methods and skin passes may be used in various products such as tires, hoses, conveyor belts, power transmission products, and other products reinforced by steel wire. In tires, the wire has particular application as filaments that are stranded together and then cabled to form tire cords. The cords, depending on the size, are useful in tread reinforcing plies such as belts, underlays, or overlays, and carcass plies. The wire may also be used to in forming tire beads. The wire, at the largest diameter, may be useful as a monofilament reinforcement in various parts of a tire.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A process for drawing a wire to a desired diameter, comprising the following steps:

a) selecting a wire having an initial diameter;

b) drawing the wire through a series of wire dies to reduce the wire diameter to a desired diameter wherein the drawing strain at each successive die is gradually reduced from the previous die by a non-constant amount.

2. The process according to claim 1 wherein the initial wire diameter is about 4.0 to about 5.5 mm.

3. The process of claim 1 wherein the wire is drawn to a desired diameter of about 2.5 to about 1.0 mm.

4. The process of claim 1 wherein the wire is drawn to a desired diameter of about 0.1 to about 0.4 mm.

5. The process according to claim 1 comprising the additional step of c) drawing the wire to further reduce the wire diameter.

6. The process according to claim 1 comprising the additional step of c) reducing the desired diameter of the wire by less than 4%.

7. The process according to claim 6 comprising the additional step of d) drawing the wire to further reduce the wire diameter.

8. The process according to claim 7 comprising the additional step of e) again reducing the wire diameter by less than 4%.

9. The process according to claim 5 or 7 wherein the drawing to further reduce the wire diameter is selected from among the following drawing methods: gradually reducing the drawing strain at each successive die of a series of dies; reducing the drawing strain at each successive die of a series of dies by a constant amount; applying a constant drawing strain at each successive die; or a combination of any of the above.

10. The process according to claim 1 wherein prior to step a), the actual steel wire strength is calculated and used to determine the drawing strain to be employed at each successive die.

11. A process for drawing a wire to desired diameter, comprising the following steps:

a) selecting a wire having an initial diameter;

b) drawing the wire through a series of wire dies to reduce the wire diameter to a desired intermediate diameter;

c) reducing the diameter of the wire by an amount less than 4% of the intermediate diameter; and d) drawing the wire through a series of wire dies to reduce the wire diameter to a desired final diameter.

12. The process according to claim 11 wherein the drawing of step b) is accomplished by selecting one of the following drawing methods: gradually reducing the drawing strain at each successive die; reducing the drawing strain at each successive die by a constant amount; applying a constant drawing strain at each successive die; or a combination of any of the above.

13. A process for drawing a wire to desired diameter, comprising the following steps:

a) selecting a wire having an initial diameter;

b) drawing the wire through a series of wire dies to reduce the wire diameter to a desired intermediate diameter;

c) heat treating the wire;

d) drawing the wire through a series of wire dies to reduce the wire diameter to a desired final diameter wherein the drawing strain at each successive die is reduced by a constant amount.

* * * * *